United States Patent [19]

Putz

[11] 4,173,438

[45] Nov. 6, 1979

[54] ROTARY PISTON DEVICE WHICH DISPLACES FLUID IN INNER AND OUTER VARIABLE VOLUME CHAMBERS SIMULTANEOUSLY

[76] Inventor: A. Frank Putz, 401 N. 89th St., Wauwatosa, Wis. 53226

[21] Appl. No.: 798,232

[22] Filed: May 18, 1977

Related U.S. Application Data

[63] Continuation-in-part of Ser. No. 632,853, Nov. 17, 1975, Pat. No. 4,030,861.

[51] Int. Cl.[2] ..... F04C 1/02

[52] U.S. Cl. ..... 418/59

[58] Field of Search ..... 418/54, 58, 59, 3; 417/462, 204

[56] References Cited

U.S. PATENT DOCUMENTS

| | | | |
|---|---|---|---|
| 1,310,157 | 10/1919 | De Campo | 418/54 |
| 1,622,816 | 3/1927 | Sperry | 418/58 X |
| 1,636,486 | 7/1927 | Planche | 418/54 |
| 1,802,887 | 4/1931 | Feyens | 418/54 |
| 2,633,805 | 4/1953 | Haugdahl | 418/27 |
| 3,119,345 | 1/1964 | Cook | 417/204 |

*Primary Examiner*—Carlton R. Croyle

[57] ABSTRACT

A variable volume rotary piston device displaces fluid simultaneously in the same direction in expansible outer chambers formed between the outer periphery of the rotary piston and the bore and in expansible inner chambers formed between the walls of a compartment in the rotary piston and a motion transmitting crankarm disposed within the compartment and integral with the shaft which operatively connects piston to shaft so that they rotate together in a one-to-one ratio and simultaneously rock the piston relative to the crankarm. The displacement in inner and outer chambers is out of phase and reduces ripple in the fluid output when the device is operated as a pump.

17 Claims, 18 Drawing Figures

ROTARY PISTON DEVICE WHICH DISPLACES FLUID IN INNER AND OUTER VARIABLE VOLUME CHAMBERS SIMULTANEOUSLY

This application is a continuation-in-part of my application Ser. No. 632,853 filed Nov. 17, 1975, now U.S. Pat. 4,030,861.

This invention relates to expansible chamber rotary piston devices such as pumps and hydraulic motors.

It is an object of the invention to provide an improved expansible chamber rotary piston device which displaces fluid in the same direction simultaneously in variable volume outer chambers formed between the piston outer periphery and the bore and in variable volume inner chambers formed between the walls of a compartment in the piston and a motion transmitting member integral with the shaft disposed within the compartment and which operatively connects the piston to the shaft so that they rotate together in a one-to-one ratio and simultaneously rock the piston relative to the shaft. It is a further object of the invention to provide such an expansible chamber device wherein the displacement, or pumping in the outer chambers is out of phase with the pumping in the inner chambers to thereby reduce ripple in the output when the device is operated as a pump, or to provide more constant speed when it is operated as a hydraulic motor. An object of one embodiment is to provide such an expansible chamber device wherein the inner and outer pumping chambers communicate at both axial ends with intake and with exhaust ports so that pumping capacity per unit time is substantially increased without inducing cavitation.

DESCRIPTION OF THE DRAWINGS

The above and other objects and advantages of the invention will be more readily apparent from the following detailed description when considered in conjunction with the accompanying drawings wherein.

Figure 1:
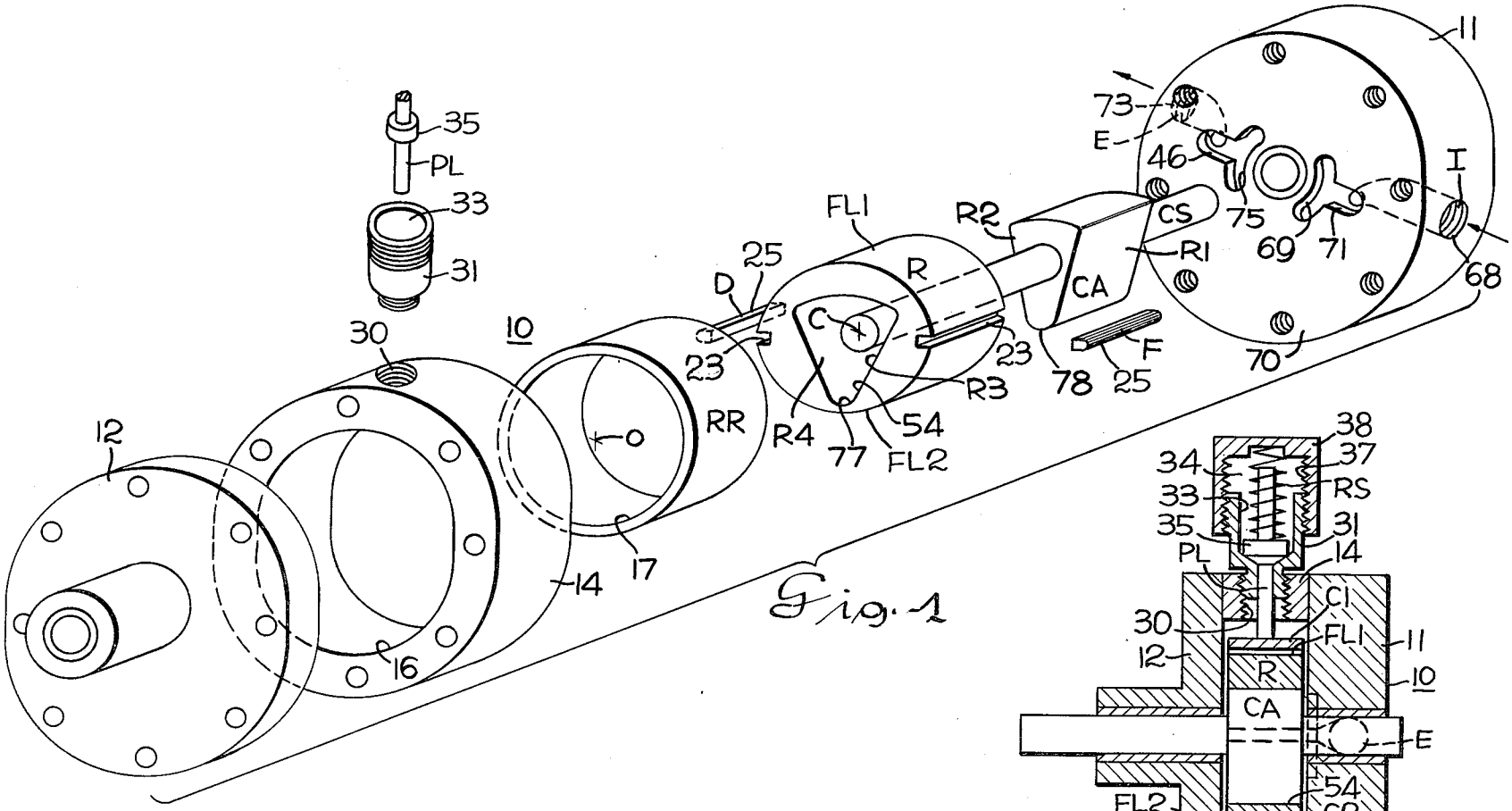
FIG. 1 is an exploded view of a variable volume, rotary piston pump embodying my invention.
Figure 2:
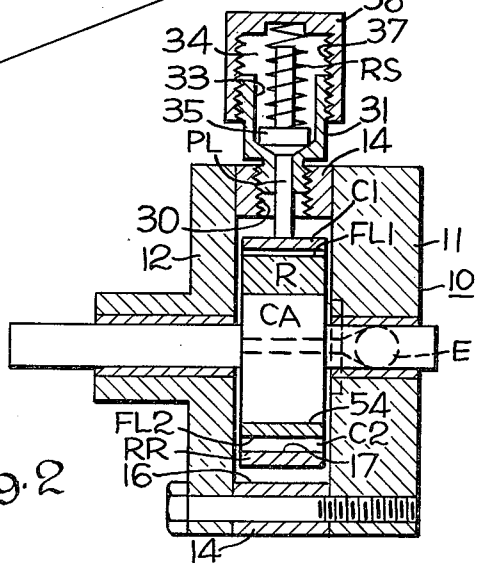
FIG. 2 is a cross section view taken radially through the asembled pump of FIG. 1.
Figures 3A, 3B, 3C, 3D, 3E, 3F, 4:
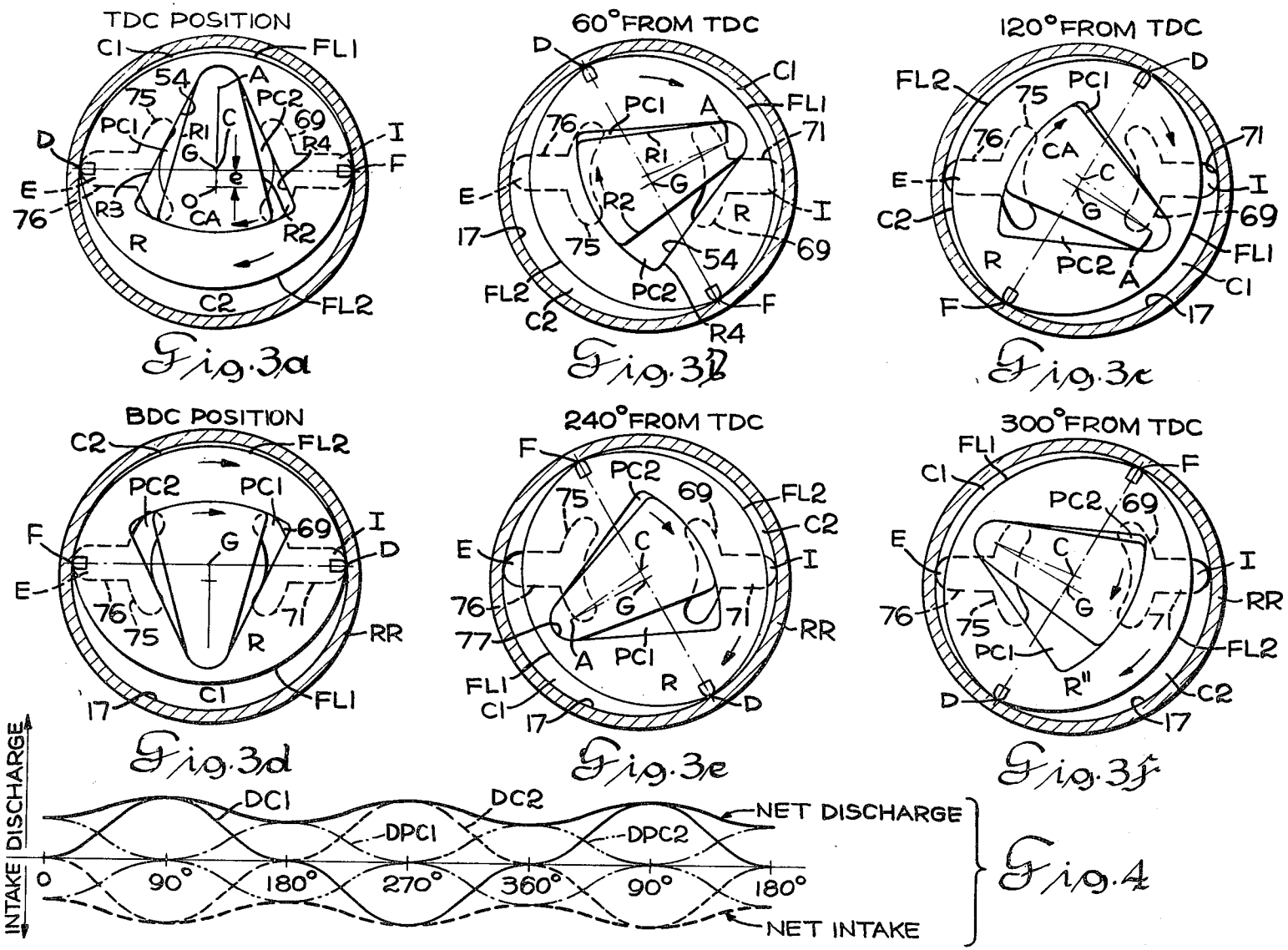
Figure 5:
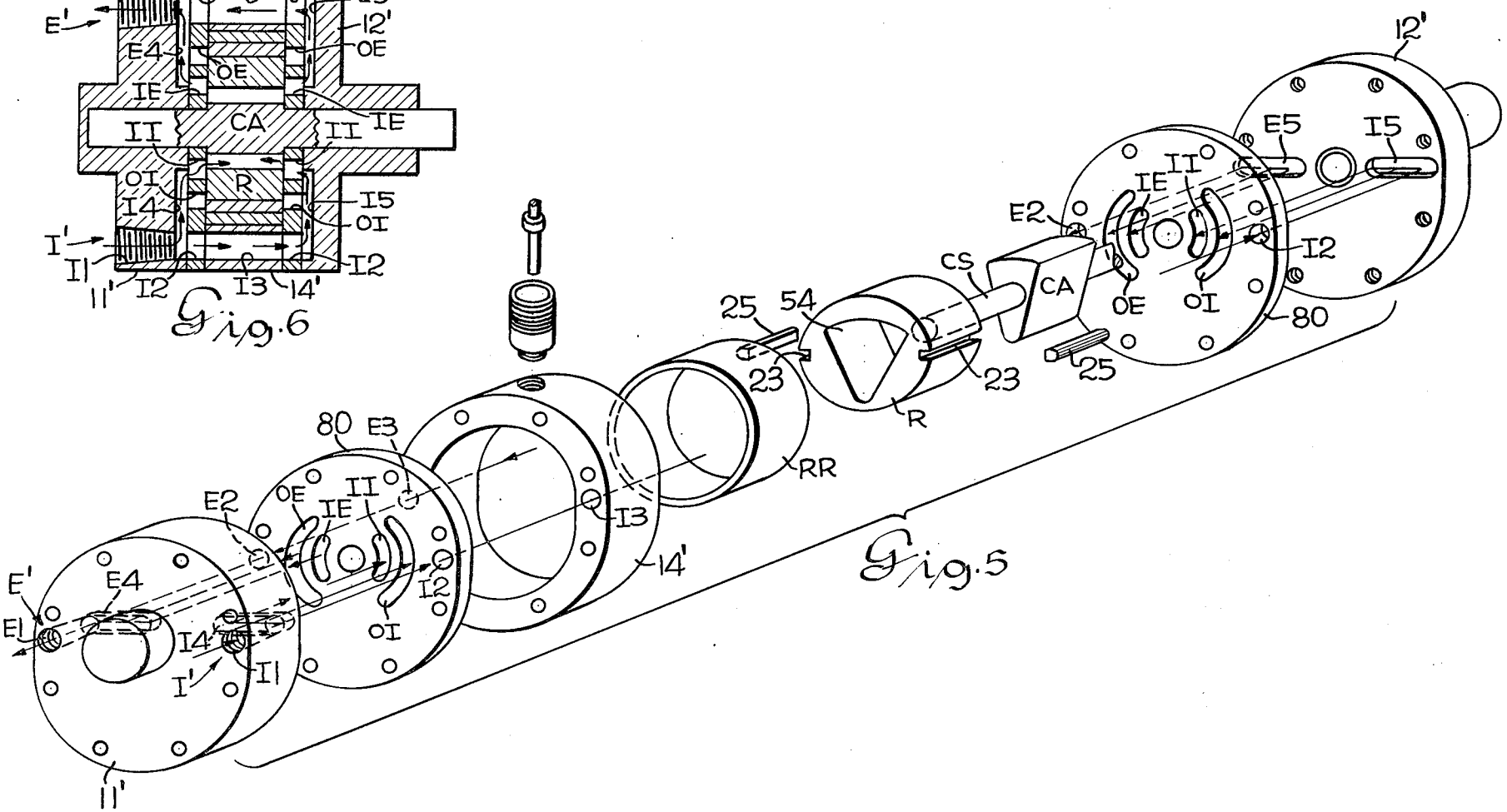
Figure 6:
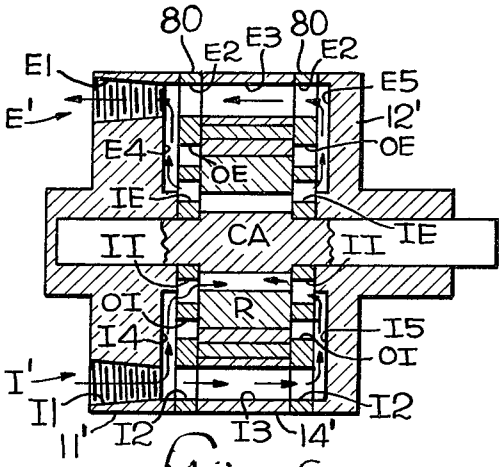
Figures 7A, 7B, 7C, 7D, 7E, 7F, 8:
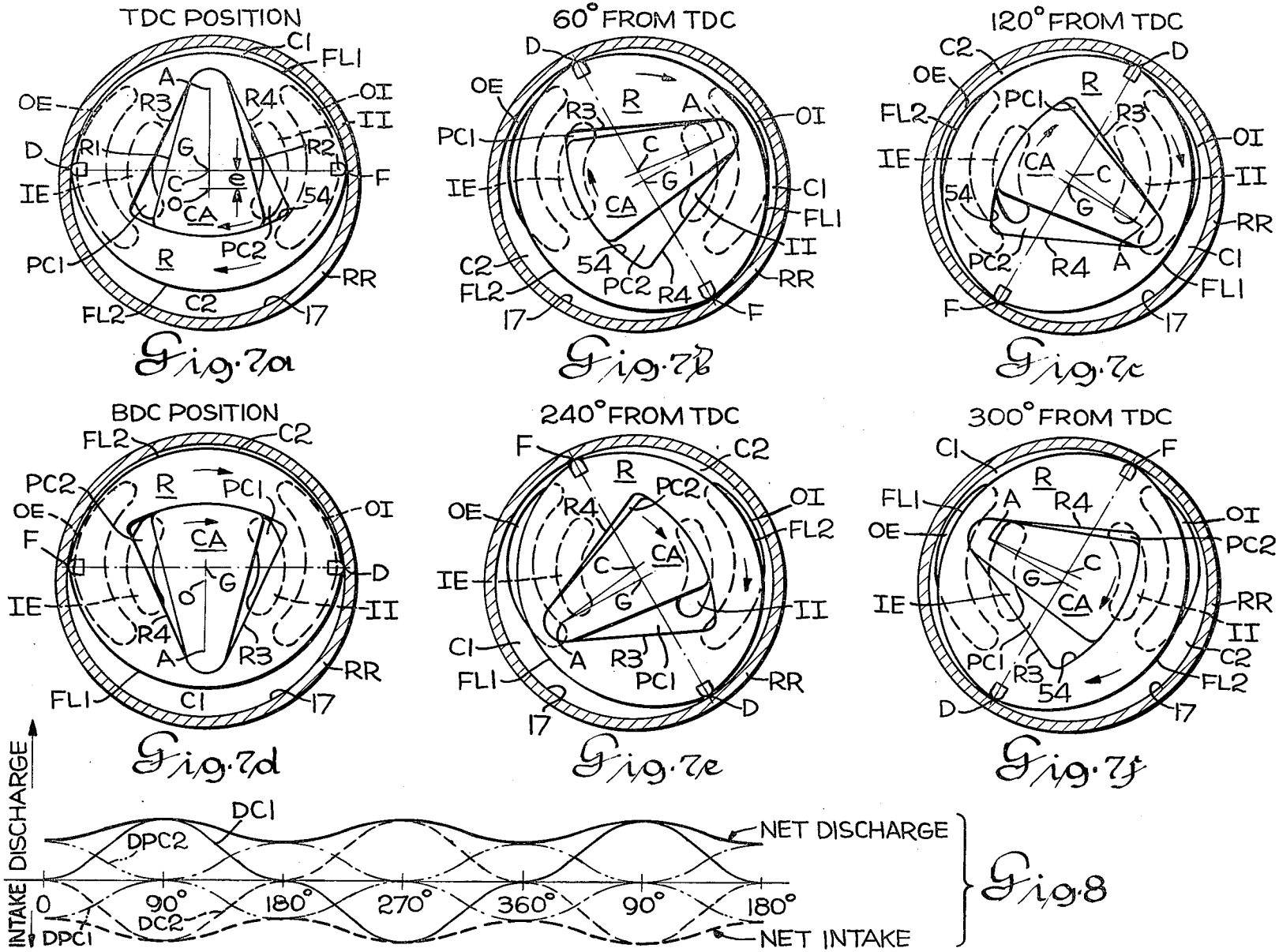

FIGS. *3a–3f* are schematic views respectively showing successive positions of the rotary piston taken 60° apart as it rotates clockwise within the bore and illustrating the intake and discharge ports in dashed lines;

FIG. 4 is a graph showing out-of-phase fluid displacement in the inner and outer pumping chambers;

FIG. 5 is an exploded view of an alternative embodiment wherein the pumping chambers communicate at both axial ends with the intake and exhaust ports to increase pumping capacity per unit time;

FIG. 6 is a cross section view taken radially through the assembled pump of FIG. 5;

FIGS. *7a–7f* are schematic views respectively showing successive positions of the rotary piston of the embodiment of FIGS. 5 and 6 taken 60° apart and illustrating the intake and exhaust port apertures in the port plates in dashed lines; and FIG. 8 is a graph similar to FIG. 4 but for the embodiment of FIGS. 5–7.

SUMMARY OF THE INVENTION

A variable volume rotary piston has a housing with a cylindrical bore and diametrically opposed intake and exhaust ports adjacent at least one axial end of the bore; a cylindrical piston rotatable within the bore and forming at least one expansible outer chamber between its outer periphery and the bore which communicates alternately with the intake port and with the exhaust port as the piston rotates; the piston has a compartment therein; a crankshaft rotatable about an axis parallel to but offset from the bore axis and having a motion transmitting crankarm integral therewith disposed within the compartment in the piston and operatively connecting piston to shaft so that they rotate toegther in a one-to-one ratio and simultaneously displace the piston within the bore and rock the piston relative to the crankarm; the crankarm forming with the walls of the compartment at least one inner expansible chamber which communicates alternately with the intake port and with the exhaust port and varies in volume between maximum and minimum during each revolution of the shaft as the piston rocks relative to the crankarm.

DETAILED DESCRIPTION

My invention is applicable to rotary piston expansible chamber devices such as those disclosed in my U.S. Pat. No. 4,008,988 but will be described as incorporated in a specific embodiment, namely, a variable displacement rotary piston device.

FIGS. 1–4 illustrate a variable displacement rotary piston device embodying my invention which reduces ripple in the output flow when operated as a pump and which, when operated as a hydraulic motor, has more constant speed than prior art devices. The embodiment of FIGS. 1–4 displaces fluid in the same direction simultaneously in outer variable volume chambers and in inner variable volume chambers, and such fluid displacements are out of phase so that the peak of one is at the node of the other with the result that ripple is minimized in the total delivery curve when the device operates as a pump. Further, the magnitude of both such fluid displacements varies as a function of eccentricity between the axes of the crankshaft and the cylindrical bore. The embodiment of FIGS. 1–4 has inlet and exhaust ports which, when the device operates as a pump, provide displacement of fluid at the rotary piston flanks from outer variable volume chambers through the discharge port and also provide displacement of fluid from inner variable volume chambers by the motion transmitting crankarm through the discharge port which is maximum at the nodes of the sinusoidal output curve that graphs total delivery from the outer chambers by the rotary piston flanks to thereby minimize ripple in the delivery of the pump.

Rotary piston R is rotatable and radially reciprocable within a cylindrical bore 17 formed by the internal wall in a chamber-defining, or bore-defining reaction ring RR which is movable longitudinally in elongated cavity 16 in intermediate section 14 in housing 10. The invention is also applicable to rotary piston devices which are not of the variable displacement type such as disclosed in my U.S. Pat. No. 4,008,988 and wherein the cylindrical bore is provided directly in the housing rather than in a chamber-defining member such as RR movable within a cavity in the housing. Rotary piston R is preferably lenticular in cross section with apex seal slots 23 at its apices D and F which extend longitudinally of its cross section and slidably receive apex seal plates 25. Although apex seal plates 25 physically contact the working chamber surface 17, the radial movement thereof within slots 23 is so minute that the seal plates may be considered the apices, i.e., the tips D and F of piston R which "track" along the bore 17. The geometric center G (see FIG. 3) of the lenticular cross section lies along the straight line connecting apices D and F.

Rotary piston R has a generally sector-shaped compartment 54 therein which receives a generally sector-shaped motion transmitting crankarm CA that is integral with crankshaft CS whose axis C is parallel to but eccentric from the axis O of cylindrical bore 17. Compartment 54 is of generally sector-shaped cross section partially defined by two diverging radial wall portions R3 and R4 which at their converging ends merge into an arcuate bearing wall portion 77 that defines the area of driving and pivotal connection between crankarm CA and rotary piston R and is disposed radially outward from the geometric center G of the cross section of rotary piston R in the manner disclosed in my aforementioned U.S. patent. Generally sector-shaped motion transmitting crankarm CA has converging radial wall portons R1 and R2 and also has a rounded force transmitting tip 78 adjacent its narrow end in abutting and pivotal relation with bearing wall portion 77 of rotary piston R.

Sector-shaped compartment 54 subtends a substantially greater central angle than that subtended by sector-shaped crankarm CA so that crankarm CA is free to rock, or pivot within compartment 54 while piston R and crankshaft CS rotate together in a one-to-one ratio within bore 17 in reaction ring RR. The rounded tip 78 of crankarm CA pivots within bearing wall portion 77 of rotor R to provide a force transmitting connection therebetween about a point A which is displaced radially outward from geometric center G (see FIG. 3) of piston R cross section.

Inlet port I and exhaust, or discharge port E are both in housing end section 11. The radially outer end 68 of inlet port I is in the circumference of end section 11, and inlet port I at its radially inner end includes an arcuate portion 69 in the axially facing surface 70 of end section 11 which registers with compartment 54 in rotary piston R and merges into a radially outward extending portion 71 that communicates with variable volume outer chambers C1 and C2 (see FIGS. 2 and 3) formed respectively between rotary piston flanks FL1 and FL2 and reaction ring internal wall which defines bore 17. Exhaust port E is disposed diametrically opposite from inlet port I and is similar thereto in having its radially outer end 73 in the circumference of end secton 11 and having the radially inner end thereof in the axially facing surface 70 of end section 11 including an arcuate opening 75 in surface 70 that communicates with compartment 54 in rotary piston R and which merges into a radially outward extending portion 76 that registers with variable volume outer chambers C1 and C2.

Intermediate section 14 has a radially extending threaded aperture 30 aligned with the longitudinal axis of obround internal cavity 16 into which a tubular bushing 31 having external threads is secured. Bushing 31 has a central opening 33 which registers with internal cavity 16 and in which a plunger PL slidably reciprocates so that the inner end of plunger PL abuts against reaction ring RR internally of housing 10. Bushing 31 also has an enlarged diameter compartment 34 which slidably receives an enlarged diameter circumferential projection 35 on plunger PL intermediate its ends and which limits radially inward travel of plunger PL. The outer end of plunger PL extends into the axial opening in a compression type reaction spring RS which at its inner end abuts against circumferential projection 35. The outer end of reaction spring RS extends into a threaded opening 37 in a pressure adjusting cap 38 and abuts against the top surface thereof. The female threads on pressure adjusting cap 38 engage external threads on bushing 31. Turning of pressure adjusting cap 38 relative to bushing 31 varies the loading of reaction spring RS, which is compressed between projection 35 and the upper surface of cap 38, and thus changes the force with which reaction spring RS resiliently urges chamber-defining ring RR toward one end of internal cavity 16 wherein eccentricity e between the axes of shaft CS and cylindrical bore 17 is maximum so that maximum fluid displacement is obtained.

As disclosed in my aforementioned U.S. Pat. No. 4,008,988, crankarm CA is the sole force transmitting means between rotary piston R and crankshaft CS, and rotary piston R is pivotally coupled to crankarm CA so that it rotates together with crankshaft CS in a one-to-one ratio within bore 17 while apices D and F remain in continuous sliding contact with bore 17 and cam piston R as it rotates so that it simultaneously rocks about rounded tip 78 relative to crankarm CA and to crankshaft CS and so that a straight line connecting apices D and F remains perpendicular in all positions of piston R to a rotatable "reference diameter" extending through the bore axis O, the geometric center G of the piston cross section, and the point A of pivotal coupling between piston R and crankarm CA. Apices D and F are cammed on bore 17 as piston R rotates so that geometric center G reciprocates along the reference diameter OGA to vary the outer chambers C1 and C2 inversely from minimum volume to maximum volume and back to minimum volume during each revolution of crankshaft CS while piston R simultaneously rocks relative to crankarm CA to vary the volume of inner pumping chambers PC1 and PC2 inversely between maximum and minimum during each revolution of shaft CS.

The cross section of bore 17 is circular as shown in FIGS. 1-4 but may alternatively be generally elliptical or another closed curve which is the locus of points (as disclosed in my U.S. Pat. No. 4,008,988) traced when an imaginary triangle (not shown) whose altitude is equal to the radial length of the crankarm CA is rotated together with the crankarm about the point A of pivotal connection between piston and crankarm so as to maintain the straight line connecting apices D and F perpendicular to the reference diameter OGA in all positions of the crankshaft.

The crankarm radial walls R1 and R2 together with the respective opposing radial walls R3 and R4 of compartment 54 form inner variable volume pumping chambers PC1 and PC2 (see FIG. 3) on opposite sides of crankarm CA out of which crankarm CA displaces or squeezes fluid through exhaust port E and which fluid displacement is in addition to the fluid displaced by flanks FL1 and FL2 from variable volume outer chambers C1 and C2 when the device operates as a pump. The magnitude of fluid displacement by piston flanks FL1 and FL2 from variable volume outer chambers C1 and C2 is proportional to the eccentricity e between the axis O of bore 17 in reaction ring RR and the axis C of shaft CS and similarly the magnitude of fluid displaced by crankarm CA from pumping chambers PC1 and PC2 is also proportional to eccentricity e.

FIG. 3 schematically illustrates successive positions or rotary piston R spaced 60° apart as it rotates in the clockwise direction within bore 17 in reaction ring RR and shows intake port I and discharge port E in dashed lines. At the top dead center (TDC) positon shown in FIG. 3*a*, flank FL1 is closely adjacent bore 17 so the volume of outer chamber C1 is minimum; flank FL2 has maximum spacing form bore 17 so the volume of outer chamber C2 is maximum; neither outer chamber C1 or C2 registers with intake port I or exhaust port E so that displacement (in the sense of fluid delivery) by flanks FL1 and FL2 through the ports is minimum; sector-shaped compartment 54 in piston R registers with arcuate portion 69 of intake port I and also with arcuate portion 75 of discharge port E so that fluid is being squeezed out of inner pumping chamber PC1 by radial wall portion R1 of clockwise rotating crankarm CA moving toward radial wall R3 of rotary piston R and fluid is simultaneously being inducted into inner pumping chamber PC2 through arcuate portion 69 of intake port I by crankarm radial wall R2 moving away from piston radial wall R4. It will be noted from FIG. 4 that fluid displacements DPC1 and DPC2 by crankarm CA in inner chambers PC1 and PC2 are ninety degrees out of phase with fluid displacements DC1 and DC2 from outer chambers C1 and C2 by flanks FL1 and FL2.

After sixty degree clockwise rotation of crankshaft CS from top dead center, rotary piston R has rocked relative to crankarm CA as shown in FIG. 3*b* and the geometric center G of its lenticular cross section has reciprocated along the reference diameter OGA so that rotary piston flank FL1 has receded away from bore 17 and outer chamber C1 communicates with radial portion 71 of intake port I and is inducting fluid therein; rotary piston flank FL2 has moved toward bore 17 and is displacing fluid out of radial portion 76 of discharge port E; compartment 54 in rotary piston R still registers with both arcuate portion 75 of discharge port E and with arcuate portion 69 of intake port I so that radial wall portion R1 of crankarm CA is squeezing fluid out from inner pumping chamber PC1 through arcuate portion 75 of discharge port E and fluid displacement DPC1 by crankarm CA is approaching minimum; and radial wall portion R2 of crankarm CA is still receding from piston wall portion R4 so that the volume of inner pumping cavity PC2 is approaching maximum and it still registers with arcuate portion 69 of intake port I so that fluid is being inducted into PC2.

After 90° rotation of crankshaft CS from TDC (not shown), displacement of fluid DC2 by piston flank FL2 through radial portion 76 of discharge port E is maximum and displacement of fluid DPC1 by crankarm wall portion R1 out of inner pumping chamber PC1 is minimum. In FIG. 4 the fluid displacement in chambers C1, C2, PC1 and PC2 through the intake and exhaust ports is respectively designated DC1, DC2, DPC1 and DPC2, and it will be noted that at 90° from TDC displacement DC1 by flank FL1 from chamber C1 through discharge port E is approximately 90° out of phase with fluid displacemet DPC1 by crankarm CA from inner pumping chamber PC1 through discharge port E.

After 120° clockwise rotation of crankshaft CS from TDC shown in FIG. 3*c*, rotary piston R has rocked through a different angle relative to crankarm CA and its geometric center G has reciprocated along the reference diameter OGA so that flank FL1 has receded further from bore 17 and outer chamber C1 still registers with radial portion 71 of intake port I and is inducting fluid therein; flank FL2 has approached closer to bore 17 while outer chamber C2 remains in communication with radial portion 76 of discharge port E; inner pumping chamber PC1 no longer communicates with discharge port E and now registers with arcuate portion 69 of intake port I and is inducting fluid therein; and inner pumping chamber PC2 no longer registers with intake port I but rather communicates with arcuate portion 75 of discharge port E so that fluid is being displaced by crankarm CA from PC2 through discharge port E.

After 180° clockwise rotation of crankshaft CS from TDC to bottom dead center (BDC) position shown in FIG. 3*d*, rotary piston R is returned to a position wherein its geometric center G is again coincident with the axis C of crankshaft CS; flank FL2 of rotary piston R is closely contiguous bore 17 and the volume of outer chamber C2 is minimum; flank FL1 has maximum spacing from bore 17 so volume of outer chamber C1 is maximum; neither outer chamber C1 nor C2 register with intake port I or discharge port E so that fluid displacement (i.e., delivery) by flanks FL1 and FL2 through exhaust port E is minimum; inner pumping chambers PC1 and PC2 respectively register with intake port arcuate portion 69 and with discharge port arcuate portion 75 and fluid displacemet DPC1 and DPC2 therein is maximum.

After 240° from TDC clockwise rotation of crankshaft CS shown in FIG. 3*e*, rotary piston R has rocked relative to crankarm CA so that the longitudinal axis DF of its cross section is no longer perpendicular to the longitudinal axis of crankarm CA; the longitudinal axis DF of piston R remains perpendicular to the rotatable reference diameter OGA through geometric center G, the center O of the bore cross section curve, and the point A of pivotal coupling between crankarm CA ad piston R; the geometric center G of the rotary piston cross section has reciprocated along the reference diameter as the piston rotated so that flank FL2 has receded away from bore 17 and outer chamber C2 has increased in volume and registers with intake port radial portion 71 and is inducting fluid therein; flank FL1 has approached toward bore 17 and is displacing fluid from outer chamber C1 through discharge port radial portion 76; pumping cavity PC1 still overlaps intake arcuate portion 69 and pumping cavity PC2 still has slight overlap with discharge port arcuate portion 75; and fluid displacement in both pumping cavities PC1 and PC2 is approaching minimum.

After 300° clockwise rotation of crankshaft CS from TDC shown in FIG. 3*f*, flank FL1 is approaching TDC and is displacing fluid from outer chamber C1 through radial portion 76 of discharge port E; flank FL2 is receding from bore 17 so the volume of outer chamber C2 is increasing and outer chamber C2 registers with the radial portion 71 of intake port I and is inducting fluid therein; pumping cavity PC1 registers with arcuate portion 75 of discharge port E and fluid displacement therein is approaching maximum; and inner pumping chamber PC2 registers with arcuate portion 69 of intake port I so that fluid is being inducted into PC2.

FIG. 4 plots fluid displacement through exhaust port E and intake port I versus rotation of shaft CS from top dead center and shows that fluid displacement DC2 and DC1 in outer chambers C2 and C1 by flanks FL2 and FL1 respectively is maximum at 90° and 270° from TDC whereas fluid displacement DPC1 and DPC2 by crankarm CA in inner chambers PC1 and PC2 is respectively maximum at approximately 0° and at 180° from TDC and that, consequently, the net flow from the disclosed pump has minimum ripple in the output delivery.

It will be appreciated that the approximately ninety degree out of phase relation between fluid displacements DC1, DC2 by the rotary piston flanks from the fluid displacements DPC1, DPC2 by crankarm CA will permit self-starting when the device operates as a hydraulic motor.

FIG. 3 illustrates only one positon of reaction ring RR within elongated cavity 16, and it will be appreciated that the degree of overlap of pumping cavities PC1 and PC2 with inlet port I and with discharge port E varies with the eccentricity e between the axis C of shaft CS and axis O of bore 17. However, maximum fluid displacement by crankarm CA in inner chambers PC1 and PC2 will remain approximately 90° out of phase from maximum displacement in outer chambers C1 and C2 by flanks FL1 and FL2 regardless of eccentricity e. Further the magnitude of fluid displacement DC1, DC2 through the intake and exhaust ports in both chamber C1 and C2 and the fluid displacements DPC1, DPC2 in inner chambers PC1 and PC2 through the intake and exhaust ports will vary with eccentricity e but the magnitude of all such displacements will vary in proportion to the eccentricity e and in the same direction.

Reaction spring RS urges reaction ring RR to a maximum volumetric displacement (minimum discharge pressure position) against one end of internal cavity 16 wherein the axis C of crankshaft CS is offset from the axis 0 of bore 17 by eccentricity e. Delivery of the pump is proportional to eccentricity e. Changing the position of chamber-defining member RR within cavity 16 varies the eccentricity and thus changes displacement; i.e., delivery. When the force of reaction spring RS acting on reaction ring RR is higher than the thrust (i.e., the reaction forces of fluid being squeezed out of discharge port E) of the reaction ring RR, eccentricity and displacement are maximum. As fluid discharge pressure increases, the reaction force pushes the chamber-defining member RR against spring RS to thereby decrease eccentricity, and hence delivery. At a predetermined fluid output pressure, the eccentricity e between curve center O and crankshaft axis C is reduced to such a small value that flow is reduced to zero. The predetermined pressure at which displacement begins to decrease can be adjusted by turning pressure adjusting cap 38 to thereby vary the force of reaction spring RS.

Communication between the variable volume chambers and the intake and exhaust ports occurs only at one axial end of the chambers in the embodiment of FIGS. 1–4. In the embodiment shown in FIGS. 5–8 communication exists at both axial ends of the variable volume chambers with the intake and exhaust ports, thereby increasing the displacment capacity per unit time without inducing cavitation which might otherwise result from very high fluid velocity. Like parts in the two embodiments are given the same reference characters, and elements of the FIGS. 5–8 structure similar to those of the FIGS. 1–4 embodiment are given the same reference characters with the prime (') designation added. In the embodiment of FIGS. 5–8 port plates 80 are disposed between intermediate housing section 14' and housing end sections 11' and 12'. Each port plate 80 has diametrically opposed, arcuate, inner intake port and exhaust port apertures II and IE adapted to register with inner variable volume chambers PC1 and PC2 and also has diametrically opposed, arcuate, outer intake port and exhaust port apertures OI and OE adapted to register with variable volume outer chambers C1 and C2 as rotary piston R revolves. Intake port I' includes an opening I1 in housing end portion I1' parallel to its axis and which is aligned with bypass openings I2 in both port plates 80 and with a bypass opening I3 in intermediate housing section 14' and also includes radially extending slots I4 and I5 in the radially extending faces of housing end portions 11' and 12' respectively which overlap the inner intake and outer intake apertures II and OI in both port plates 80, thereby interconnecting the inner intake port aperture II with the outer intake port aperture IE, as shown by the arrows in FIG. 6. In a similar manner exhaust port E' includes an opening E1 in housing end section 11' parallel to its axis and which is aligned with bypass openings E2 in both port plates 80 and with a bypass opening E3 in intermediate housing section 14' and also includes radially extending slots E4 and E5 in the radially extending faces of housing end portions 11' and 12' respectively which overlap the inner exhaust and outer exhaust apertures IE and OE, thereby interconnecting the inner and outer exhaust port apertures IE and OE in both port plates 80 as shown by the arrows in FIG. 6. Fluid flowing into intake port I' passes through aligned apertures I1, I2, I3 and radially through slots I4 and I5 into the inner and outer intake apertures II and OI in both port plates 80. Fluid displaced from inner chambers PC1 and PC2 through inner exhaust port aperture IE, and from outer chambers C1 and C2 through outer exhaust port OE, in the port plates 80 flows through radial slots E4 and E5 in the end housing sections 11' and 12' and then through aligned exhaust port openings E3, E2 and E1.

FIGS. *7a–7f* schematically illustrate successive positions of rotary piston R spaced 60° apart as it rotates clockwise within bore 17 in reaction ring RR and shows the inner and outer port apertures in the port plates 80 in dashed lines. At the top dead center (TDC) position shown in FIG. *7a*, flank FL1 of piston R is closely adjacent bore 17 and outer chamber C1 does not overlap outer intake port aperture OI or outer exhaust port aperture OE; outer chamber C2 does not register with either outer intake port OI or outer exhaust port aperture OE; inner variable volume chamber PC2 formed between crankarm CA and radial wall R4 of piston R registers with inner intake port aperture II so that fluid is being induced therein at maximum displacement DPC1; and inner chamber PC1 formed between crankarm CA and radial wall R3 in piston R registers with inner exhaust aperture IE so that maximum volume of fluid is being squeezed from chamber PC1 through inner exhaust port aperture IE in both port plates 80.

After 60° clockwise rotation of shaft CS from top dead center, rotary piston R has rocked relative to crankshaft CA as shown in FIG. *7b* and the geometric center G of piston R has reciprocated along the reference diameter OGA so that rotary piston flank FL1 has receded away from bore 17 and outer chamber C1 registers with outer intake apertures OI in both port plates and is inducting fluid therein; flank FL2 has moved toward bore 17 and is displacing fluid out of outer chamber C2 through outer exhaust port apertures OE; compartment 54 in piston R still registers with both inner intake port aperture II and inner exhaust port aperture IE so radial wall portion R1 is approaching wall portion R3 and displacement DPC1 from inner chamber PC1 through IE is approaching minimum; and crankarm radial wall portion R2 is still receding from piston wall portion R4 so that the volume of inner pumping chamber PC2 is approaching maximum and fluid is being induced therein through inner intake apertures II in both port plates 80.

After 90° from top dead center (not shown) displacement of fluid DC2 by piston flank FL2 form outer chamber C2 through outer exhaust port apertures OE is maximum and displacement DPC1 of fluid from inner chamber PC1 by crankarm radial wall R1 through iner exhaust port apertures IE is minimum.

After 120° clockwise rotation of crankshaft CS from TDC shown in FIG. 7*c*, rotary piston R has rocked through a different angle relative to crankarm CA and its geometric center G had reciprocated along the reference diameter so that flank FL1 has receded further from bore 17 and outer chamber C1 still registers with outer intake apertures OI and is inducting fluid therein; flank FL2 has approached closer to bore 17 while outer chamber C2 remains in communication with outer exhaust apertures OE in both port plates 80; inner chamber PC1 no longer registers with inner exhaust apertures IE and now registers with inner intake apertures II and is inducting fluid therein; and inner pumping chamber PC2 no longer registers with inner intake apertures II but rather registers with inner exhaust apertures IE so that fluid is being displaced by crankarm CA from PC2 through discharge port apertures IE in both port plates 80.

After 180° clockwise rotation of crankshaft CS from TDC to bottom dead center (BDC) position shown in FIG. 7*d*, piston R is returned to a position wherein its geometric center G is again coincident with axis C of shaft CS; flank FL2 of piston R is closely contiguous bore 17 and the volume of outer chamber C2 is minimum and C2 does not register with intake port aperture OI or outer exhaust port aperture OE; flank FL1 has maximum spacing from bore 17 so volume of outer chamber C1 is maximum but it does not register with OI or OE so that fluid displacement (i.e.) delivery by flank FL1 from outer chamber C1 through outer exhaust apertures OE is minimum; inner pumping chambers PC1 and PC2 register respectively with inner intake apertures II and inner exhaust apertures IE and fluid displacement DPC1 and DPC2 therein is maximum.

After 240° of clockwise rotation of crankshaft CS from TDC shown in FIG. 7*e*, rotary piston R has rocked relative to crankarm CA so that the longitudinal axis DF of the piston cross section is no longer perpendicular to the longitudinal axis of crankarm CA; the geometric center G of the piston cross section has reciprocated along the reference diameter so that flank FL2 has receded from bore 17 and outer pumping chamber C2 has increased in volume and is inducing fluid through outer intake apertures OI in both port plates 80; flank FL1 has approached bore 17 and is displacing fluid from outer chamber C1 through outer exhaust apertures OE; inner pumping chamber PC1 overlaps inner intake apertures II and inner pumping chamber PC2 overlaps inner exhaust apertures IE and fluid displacement in both inner pumping chambers is approaching minimum.

After 300° clockwise rotation of crankshaft CS from TDC shown in FIG. 7*f*, flank FL1 is again approaching TDC and is displacing fluid from outer pumping chamber Cl through outer exhaust apertures OE in both port plates 80; flank FL2 is receding from bore 17 so the volume of outer chamber C2 is increasing and it registers with outer intake apertures OI and is inducting fluid therein; inner pumping chamber PCl registers with inner exhaust apertures IE and fluid displacement therein is approaching maximum; and inner pumping chamber PC2 registers with inner intake apertures II in both port plates 80 so that fluid is being inducted into PC2 through intake port aperture II while fluid is simultaneously being inducted into outer chamber C2 through outer intake port apertures OI.

FIG. 7 illustrates only one position of reaction ring RR within elongated cavity 16, and it will be appreciated that the degree of overlap of the inner and outer pumping chambers with the corresponding intake and exhaust port apertures varies with eccentricity e between the axis C of crankshaft CS and the axis O of bore 17. However, maximum fluid displacement DPC1 and DPC2 in inner chambers PC1 and PC2 will remain 90° out of phase with the maximum displacement DC1 and DC2 in outer chambers C1 and C2 by flanks FL1 and FL2 regardless of the eccentricity e. Further, the magnitude of fluid displacement in both inner chambers PC1, PC2 and in outer chambers C1 and C2 will vary with eccentricity e but the magnitude of all such displacements will vary in proportion to eccentricity e and in the same direction.

It will be appreciated that the fluid capacity per unit time will be substantially increased in the embodiment of FIGS. 5–8 wherein fluid can enter and exit from both axial ends of the pumping chambers in comparison to the FIGS. 1–4 embodiment, and further that such increased capacity per unit time is accomplished without the necessity of high fluid velocities which might otherwise induce cavitation.

While only a few embodiments of my invention have been illustrated and described, many modifications and variations thereof will be readily apparent to those skilled in the art, and consequently I do not intend to be limited to the particular embodiments shown and described.

The embodiments of the invention in which an exclusive property or privilege is claimed are defined as follows:

1. A rotary piston expansible chamber device comprising, in combination, a housing having a cylindrical bore and diametrically opposed intake and exhaust ports adjacent at least one axial end of said bore, a cylindrical piston rotatable within said bore and being lenticular in cross section and having arcuately spaced apices which maintain substantially continuous contact with said bore and divide it into first and second expansible outer chambers defined between the flanks of said lenticular piston and said bore adapted to to alternately communicate with said intake port and with said exhaust port as said piston rotates, said piston having a compartment therein.

a shaft rotatable about an axis parallel to but offset from the bore axis and having a member integral therewith disposed within and movable within said compartment and forming with the compartment walls at least one expansible inner chamber adapted to communicate with said intake port and also with said exhaust port as said piston rotates, and means including said member disposed within said compartment for operatively connecting said piston to said shaft so that they rotate together in a one-to-one ratio and simultaneously reciprocate said piston within said bore so that the volume of said first and of said second outer chamber varies between maximum and minimum during each revolution of said shaft and also move said member within said compartment so that the volume of said inner chamber varies between minimum and maximum during each revolution of said shaft, said diametrically opposed intake and exhaust ports being positioned so that each can communicate with only one of said outer chambers at a time and so that both said ports are out of communication with said outer chambers when the outer peripheral flanks of said piston are repectively in closest proximity to said bore.

2. A rotary piston expansible chamber device in accordance with claim 1 wherein said member forms first and second expansible inner chambers with the walls of said compartment which alternately communicate with said intake port and alternately communicate with said exhaust port as said piston rotates and wherein said means for operatively connecting move said member within said compartment so that said first and second inner chambers vary inversely in volume between minimum and maximum during each revolution of said shaft.

3. A rotary piston expansible chamber device comprising, in combination, a housing having a cylindrical bore and diametrically opposed intake port means and exhaust port means adjacent at least one axial end of said bore, a cylindrical piston rotatable within said bore and dividing it into first and second expansible outer chambers formed between the piston outer periphery and said bore and which alternately communicate with said intake port means and also communicate alternately with said exhaust port means as said piston rotates, and piston having a compartment therein extending parallel to its axis, said piston being lenticular in cross section and having arcuately spaced apices which remain in substantially continuous contact with each bore in all positions of said piston within said bore.

a shaft rotatable about an axis parallel to but offset from the bore axis and having a motion transmitting crankarm disposed within said compartment dividing it into first and second expansible inner chambers formed between the outer periphery of said crankarm and the walls of said compartment and which communicate alternately with said intake port means and also communicate alternately with said exhaust port means as said piston rotates, and means including said crankarm disposed within said compartment for operatively connecting said piston to said shaft so that they rotate together in a one-to-one ratio and simultaneously displace said piston so that it varies the volume of said first and second outer chambers inversely between maximum and minimum during each revolution of said shaft and also rock said piston relative to said crankarm so that said first and second inner chambers vary inversely in volume between maximum and minimum during each revolution of said shaft, said diametrically opposed intake and exhaust ports being located so that each can communicate with only one of said outer chambers and one of said inner chambers at a time and so that both such ports are substantially out of communication with said outer chambers when the outer peripheral flanks of said piston are respectively in closest proximity to said bore.

4. A rotary piston expansible chamber device in accordance with claim 3 wherein the fluid displacement in said first and second inner chambers is out of phase with the fluid displacement in said first and second outer chambers.

5. A rotary piston expansible chamber device comprising, in combination, a housing having a cylindrical bore and diametrically opposed intake and exhaust ports at both axial ends of said bore, said intake port including radially spaced apart inner and outer intake port apertures in communication with each other and said outlet port being diametrically opposed to said intake port and including radially spaced apart inner and outer exhaust port apertures in communication with each other, a lenticular-in-cross-section cylindrical rotary piston rotatable within said bore and having first and second circumferentially spaced apices which remain in continuous contact with said bore and cam said piston as it rotates and divide said bore into first and second variable volume outer chambers between the outer periphery of said piston and said bore which alternately communicate with said outer intake port aperture and also alternately communicate with said outer exhaust port aperture as said piston rotates, said piston having an axially extending compartment therein, a shaft rotatable about an axis parallel to but offset from the bore axis and having a crankarm integral therewith disposed within said compartment and operatively connecting said piston to said shaft so that they rotate in a one-to-one ratio while permitting rocking motion of said piston relative to said shaft as they rotate together, said crankarm forming first and second variable volume inner chambers with the piston walls defining said compartment which alternately communicate with said inner intake port aperture and also alternately communicate with said inner exhaust port aperture as said piston rotates, said diametrically opposed intake port and exhaust port being so located that each can communicate with only one of said outer chambers and one of said inner chambers at a time and so that both said ports are substantially out of communication with said outer chambers when the outer peripheral flanks of said piston are respectively in closest proximity to said bore, said piston being cammed on said bore so that it reciprocates within said bore to vary the volume of said first and second outer chambers between minimum and maximum during each revolution of said shaft and also so that it simultaneously rocks through an angle relative to said crankarm to vary the volume of said first and second inner chambers between minimum and maximum during each revolution of said shaft.

6. A rotary piston expansible chamber device comprising, in combination, a housing having a cylindrical bore and diametrically opposed intake and exhaust ports adjacent at least one axial end of said bore, a cylindrical piston rotatable within said bore and forming at least one expansible outer chamber with said bore adapted to communicate with said intake port and also with said exhaust port as said piston rotates, said piston having a compartment therein generally of sector-shaped cross section, a shaft rotatable about an axis parallel to but offset from the bore axis and having a crankarm integral therewith disposed within said compartment and forming with the compartment walls at least one expansible inner chamber adapted to communicate with said intake port and also with said exhaust port as said piston rotates, and wherein said crankarm is also of generally sector-shaped cross section with its vertex abutting the vertex of said sector-shaped compartment to pivotally engage said crankarm with said rotary piston, and means including said crankarm disposed within said compartment for operatively connecting said piston to said shaft so that they rotate together in a one-to-one ratio and simultaneously reciprocate said piston within said bore so that the volume of said outer chamber varies between maximum and minimum during each revolution of said shaft and also rock said piston relative to said crankarm so that the volume of said inner chamber varies between minimum and maximum during each revolution of said shaft.

7. A rotary piston expansible chamber device in accordance with claim 6 wherein said sector-shaped compartment subtends a greater arc than said sector-shaped crankarm so that said rotary piston can rock relative to said shaft and wherein said vertex of said sector-shaped compartment is disposed radially outward from the geometric center of the rotary piston cross section.

8. A rotary piston expansible chamber device comprising, in combination, a housing having a cylindrical bore and diametrically opposed intake port means and exhaust port means adjacent at least one axial end of said bore, a lenticular-in-cross-section cylindrical piston rotatable within said bore having arcuately spaced apices which remain in substantially continuous contact with said bore in all positions of said piston within said bore and dividing it into first and second expansible outer chambers formed between the piston outer periphery and said bore and which alternately communicate with said intake port means and also communicate alternately with said exhaust port means as said piston rotates, said piston having a generally sector-shaped in cross section compartment therein extending parallel to its axis, a shaft rotatable about an axis parallel to but offset from the bore axis and having a motion transmitting crankarm disposed within said compartment dividing it into first and second expansible inner chambers formed between the outer periphery of said crankarm and the walls of said compartment and which communicate alternately with said intake port means and also communicate alternately with said exhaust port means as said piston rotates, and wherein said crankarm is also generally sector-shaped in cross section but subtends a smaller included angle than said compartment so that said piston can rock within said compartment, and means including said crankarm disposed within said compartment for operatively connecting said piston to said shaft so that they rotate together in a one-to-one ratio and simultaneously displace said piston so that it varies the volume of said first and second outer chambers inversely between maximum and minimum during each revolution of said shaft and also rock said piston relative to said crankarm so that said first and second inner chambers vary inversely in volume between maximum and minimum during each revolution of said shaft.

9. A rotary piston expansible chamber device in accordance with claim 8 wherein said intake port means has intake port apertures at both axial ends of said bore which are in communication with each other and said exhaust port means has exhaust port apertures at both axial ends of said bore which are in communication with each other.

10. A rotary piston expansible chamber device comprising, in combination, a housing having a cylindrical bore and diametrically opposed intake and exhaust ports at both axial ends of said bore, said intake port including radially spaced apart inner and outer intake port apertures in communication with each other and said outlet port being diametrically opposed to said intake port and including inner and outer exhaust port apertures in communication with each other, a cylindrical rotary piston rotatable within said bore and forming first and second variable volume outer chambers between the outer periphery of said piston and said bore which alternately communicate with said outer intake port aperture and also alternately communicate with said outer exhaust port aperture as said piston rotates, said piston having an axially extending compartment therein which is generally sector-shaped in cross section, a shaft rotatable about an axis parallel to but offet from the bore axis and having a crankarm integral therewith disposed within said compartment and operatively connecting said piston to said shaft so that they rotate in a one-to-one ratio while permitting rocking motion of said piston relative to said shaft as they rotate together, and wherein said crankarm is generally sector-shaped in cross section and subtends a smaller included angle than said compartment so that said crankarm is free to rock within said compartment, said crankarm forming first and second variable volume inner chambers with the piston walls defining said compartment on opposite sides of said crankarm which alternately communicate with said inner intake port aperture and also alternately communicate with said inner exhaust aperture as said piston rotates, said piston being cammed on said bore so that it reciprocates within said bore to vary the volume of said first and second outer chambers between minimum and maximum during each revolution of said shaft and also so that it simultaneously rocks through an angle relative to said crankarm to vary the volume of said first and second inner chambers between minimum and maximum during each revolution of said shaft.

11. A rotary piston expansible chamber device comprising, in combination, a housing having a cylindrical bore and diametrically opposed intake and exhaust ports adjacent at least one axial end of said bore, a cylindrical piston rotatable within said bore and being lenticular in cross section and having arcuately spaced apices which maintain substantially continuous contact with said bore and divide it into first and second expansible outer chambers defined between the flanks of said lenticular piston and said bore adapted to communicate with said intake port and also with said exhaust port as said piston rotates, said piston having a compartment therein, a shaft rotatable about an axis parallel to but offset from the bore axis and having a crankarm integral therewith disposed within said compartment said forming with the compartment walls at least one expansible inner chamber adapted to communicate with said intake port and also with said exhaust port as said piston rotates, and means including said crankarm disposed within said compartment for operatively connecting said piston to said shaft so that they rotate together in a one-to-one ratio and simultaneously reciprocate said piston within said bore so that the volume of said first and of said second outer chamber varies between maximum and minimum during each revolution of said shaft and also rock said piston relative to said crankarm so that the volume of said inner chamber varies between minimum and maximum during each revolution of said shaft, said intake port and said exhaust port being so diametrically opposed that each can communicate with only one of said outer chambers at a time and both said outer chambers are substantially isolated from said intake port and from said exhaust port when the flanks of said lenticular piston are respectively in closest proximity to said bore.

12. A rotary piston expansible chamber device in accordance with claim 11 which is variable in volume and wherein said housing has an elongated cavity therein which communicates with said inlet port and with said outlet port and said bore is formed by an internal opening in a chamber-defining member positioned within and movable in a direction longitudinal of said cavity to vary the eccentricity between the axis of said shaft and the axis of said bore and thus change the volumetric displacement of said device.

13. A rotary piston expansible chamber device in accordance with claim 12 and including resilient means for urging said chamber-defining member toward a position within said cavity wherein the axis of said shaft is eccentric to the axis of said bore, whereby said device is pressure compensated and volumetric displacement is a maximum when fluid pressure is minimum.

14. A rotary piston expansible chamber device in accordance with claim 11 wherein said crankarm forms first and second expansible inner chambers with the walls of said compartment and said means for operatively connecting rocks said piston relative to said shaft so that said first and second inner chambers vary inversely in volume between minimum and maximum during each revolution of said shaft.

15. A rotary piston expansible chamber device in accordance with claim 14 wherein said means for operatively connecting includes said bore and said apices in sliding engagement with said bore so camming said rotary piston that it rocks through an angle relative to said shaft and said crankarm and varies the volume of said first and second outer chambers inversely between minimum and maximum during each revolution of said shaft.

16. A rotary piston expansible chamber device in accordance with claim 14 where said housing has intake port apertures adjacent both axial ends of said bore which are in communication with each other and also has exhaust port apertures at both axial ends of said bore which are in communication with each other, said intake and exhaust port apertures being positioned so that said first and second outer chambers alternately communicate with said intake port as said piston rotates and also alternately communicate with said exhaust port and also being positioned so that said first and second inner chambers alternately communicate with said intake port as said piston rotates and also alternately communicate with said exhaust port.

17. A rotary piston expansible chamber device in accordance with claim 14 wherein said intake ports and exhaust ports are positioned so that the fluid displacement in said first and second outer chambers is out of phase with the fluid displacement in said first and second inner chambers.

* * * * *